US011500405B2

(12) United States Patent
Breslin

(10) Patent No.: US 11,500,405 B2
(45) Date of Patent: Nov. 15, 2022

(54) VOLTAGE REGULATOR CIRCUITRY

(71) Applicant: Cirrus Logic International Semiconductor Ltd., Edinburgh (GB)

(72) Inventor: John A. Breslin, Glasgow (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 17/072,070

(22) Filed: Oct. 16, 2020

(65) Prior Publication Data

US 2021/0333814 A1 Oct. 28, 2021

Related U.S. Application Data

(60) Provisional application No. 63/014,295, filed on Apr. 23, 2020.

(51) Int. Cl.
*G05F 1/575* (2006.01)

(52) U.S. Cl.
CPC ..... *G05F 1/575* (2013.01)

(58) Field of Classification Search
CPC ..... G05F 1/562
See application file for complete search history.

(56) References Cited

U.S. PATENT DOCUMENTS 4,668,906 A * 5/1987 Ekstrand ..... G05F 1/648 323/297
4,719,404 A * 1/1988 Ekstrand ..... G05F 1/648 323/224
5,717,318 A * 2/1998 Matsuda ..... H02M 3/07 323/273
7,382,635 B2 * 6/2008 Noda ..... H02M 3/07 307/110
9,122,289 B2 * 9/2015 Howes ..... G05F 1/10
9,201,441 B2 * 12/2015 Ingino ..... G05F 3/08
9,623,545 B2 * 4/2017 Mergener ..... H02P 29/0241
9,939,831 B2 * 4/2018 Verma ..... G05F 1/575
10,025,334 B1 * 7/2018 Derman ..... G05F 1/575
10,122,168 B2 * 11/2018 Goncalves ..... H02M 1/088
10,164,453 B2 * 12/2018 Nepote ..... H02J 7/16
10,496,115 B2 * 12/2019 Hung ..... G05F 1/575
10,866,607 B1 * 12/2020 Avci ..... G01S 7/484
2008/0054993 A1 * 3/2008 Rashid ..... H03F 3/68 327/538
2009/0140716 A1 * 6/2009 Mantovani ..... H05B 47/10 323/351

FOREIGN PATENT DOCUMENTS

CN 200976692 Y 11/2007
EP 3425475 A1 1/2019

OTHER PUBLICATIONS

Combined Search and Examination Report under Sections 17 and 18(3), UKIPO, Application No. GB2103371.7, dated Jan. 26, 2022.
(Continued)

*Primary Examiner* — Thomas J. Hiltunen
(74) *Attorney, Agent, or Firm* — Jackson Walker L.L.P.

(57) ABSTRACT

The present disclosure relates to voltage regulator circuitry. The voltage regulator circuitry comprises an output device configured to provide a regulated output voltage and a controllable shunt device configured to provide a current path from the output device for a shunt current. The shunt current is variable according to a control signal supplied to the controllable shunt device.

17 Claims, 6 Drawing Sheets

(56) References Cited

OTHER PUBLICATIONS

Anonymous, Wikipedia, "Switched-Capacitor Resistor", Jan. 1, 2004, pp. 1-4, URL: http://www.ecircuitcenter.com/Circuits/SWCap/SWCap.htm.

Anonymous, Wikipedia, "Pulse-Density Modulation", Mar. 28, 2019, URL: http://web.archive.org/web/20190328001620/https:/en/wikipedia.org/wiki/Pulse-density_modulation.

* cited by examiner

VOLTAGE REGULATOR CIRCUITRY

FIELD OF THE INVENTION

The present disclosure relates to voltage regulator circuitry.

BACKGROUND

An LDO (low dropout) regulator may be used to provide a regulated voltage supply within a specified voltage range to load circuitry over a specified load current range.

FIG. 1 is a schematic representation of typical LDO circuitry. As shown, the LDO circuitry (shown generally at 100) comprises differential amplifier circuitry 110, an output device 120, and a voltage divider comprising first and second series-connected resistances 132, 134. The LDO circuitry 100 also includes a reservoir capacitor 140. The differential amplifier circuitry 110, output device 120 and series-connected resistances 132, 134 may be integrated into a single integrated circuit (IC) device 150. In some arrangements, particularly where a large capacitance is required, the reservoir capacitor 140 may be provided off-chip, i.e. externally of the integrated circuit device 150, as shown in FIG. 1. In alternative arrangements the reservoir capacitor 140 may be provided internally to the integrated circuit device 150.

An output terminal of the differential amplifier circuitry 110 is coupled to a control terminal (e.g. a gate terminal) of the output device 120 (which may be, for example, a MOSFET device), so as to provide a bias voltage to the output device 120. A first terminal (e.g. a drain terminal) of the output device 120 is coupled to a supply voltage rail 160 which provides a supply voltage Vsup. The first and second resistances 132, 134 are coupled in series between a second terminal (e.g. a source terminal) of the output device 120 and a reference voltage supply, which in the illustrated example is ground.

An output terminal 170 of the circuitry 100 is coupled to the second terminal of the output device 120. Load circuitry (not shown) can be coupled to the output terminal 170 so as to receive the regulated voltage supply Vout.

In the example shown in FIG. 1, the second input terminal of the amplifier circuitry 110 is coupled to a node 136 intermediate the first and second resistances 132, 134, and thus receives a portion of the regulated voltage supply Vout as a feedback voltage Vfbck. In an alternative arrangement in which the amplifier circuitry 110 is configured as a voltage buffer (as opposed to the voltage scaler arrangement shown in FIG. 1) the second input terminal of the amplifier circuitry 110 may be coupled directly to the second terminal of the output device 120, such that the second input terminal of the amplifier circuitry 110 receives the regulated voltage supply Vout as the feedback voltage Vfbck. In either case, the feedback arrangement acts to minimise any difference between the reference voltage Vref and the feedback voltage Vfbck, by causing the amplifier circuitry 110 to adjust its output voltage which, as discussed above, is received by the control terminal of the output device 120 as its bias voltage. As will be appreciated by those of ordinary skill in the art, adjusting the bias voltage to the control terminal of the output device 120 changes the voltage across the first and second terminals (e.g. the drain-source voltage) of the output device 120, and therefore changes the regulated voltage supply Vout and hence the feedback voltage Vfbck. Thus, by minimising the difference between Vfbck and Vref, the amplifier circuitry 110 is operative to maintain the regulated supply voltage Vout within the specified voltage range.

SUMMARY

According to a first aspect, the invention provides voltage regulator circuitry comprising: an output device configured to provide a regulated output voltage; and a controllable shunt device configured to provide a current path from the output device for a shunt current, wherein the shunt current is variable according to a control signal supplied to the controllable shunt device.

The controllable shunt device may be operative to increase the shunt current in response to a control signal that is based on an indication of an expected increase in load current.

The controllable shunt device may be operative to increase the shunt current in a plurality of steps.

The controllable shunt device may be operative to reduce the shunt current in response to a control signal that is based on an indication that the regulated output voltage has stabilised following a change in a load current drawn by a load coupled to the voltage regulator circuitry.

The controllable shunt device may be operative to decrease the shunt current in a single step or in a plurality of steps.

The controllable shunt device may be operative to increase the shunt current in response to a control signal that is based on an indication of an expected decrease in load current.

The controllable shunt device may be operative to increase the shunt current in a single step or in a plurality of steps.

In some examples, a step size for increasing or decreasing the shunt current may be variable. Alternatively or additionally, a rate of change of increase or decrease of the shunt current is variable.

Lower and upper endpoint values for the shunt current may be variable.

A lower endpoint value for the shunt current may be zero.

The voltage regulator circuitry may further comprise controller circuitry configured to provide a control signal to the controllable shunt device.

The controller circuitry may be operative to output a control signal to switch the controllable shunt device off such that no shunt current flows during normal operation of the LDO circuitry, and to output a control signal to switch the controllable shunt device on so as to provide a shunt current in anticipation of a change in the load current.

The controller circuitry may be configured to receive one or more inputs from circuitry of a host device and to output control signals to cause the controllable shunt device so as to adjust the shunt current based on the received input(s).

The control signal may comprise a pulse width modulated (PWM) or pulse density modulated (PDM) signal.

The controllable shunt device may comprise one or more controllable resistances. Additionally or alternatively the controllable shunt device may comprise switched capacitor circuitry implementing one or more controllable resistances.

According to a second aspect, the invention provides circuitry comprising the voltage regulator circuitry of the first aspect and a reservoir capacitor.

According to a third aspect, the invention provides shunt circuitry for a low dropout (LDO) regulator, the shunt circuitry comprising a controllable shunt device configured to be coupled to an output device of the LDO regulator, wherein the controllable shunt device is configured to adjust a shunt current drawn from the LDO regulator according to a received control signal.

According to a fourth aspect, the invention provides voltage regulator circuitry comprising a controllable shunt device configured to control a shunt current, wherein the voltage regulator circuitry is operable in a plurality of modes, each of the plurality of modes associated with a different shunt current level, wherein the voltage regulator circuitry is switchable between modes in response to a control signal received by the controllable shunt device.

According to a fifth aspect, the invention provides integrated circuit comprising the circuitry of the first aspect.

According to a first aspect, the invention provides a device comprising the circuitry of the first aspect, wherein the device comprises a portable device, a battery powered device, a mobile telephone, a tablet or laptop computer, a smart speaker, an accessory device, a headset device, smart glasses, headphones, earphones or earbuds.

BRIEF DESCRIPTION OF THE DRAWINGS

Embodiments of the invention will now be described, strictly by way of example only, with reference to the accompanying drawings, of which.

DETAILED DESCRIPTION

Figure 1:
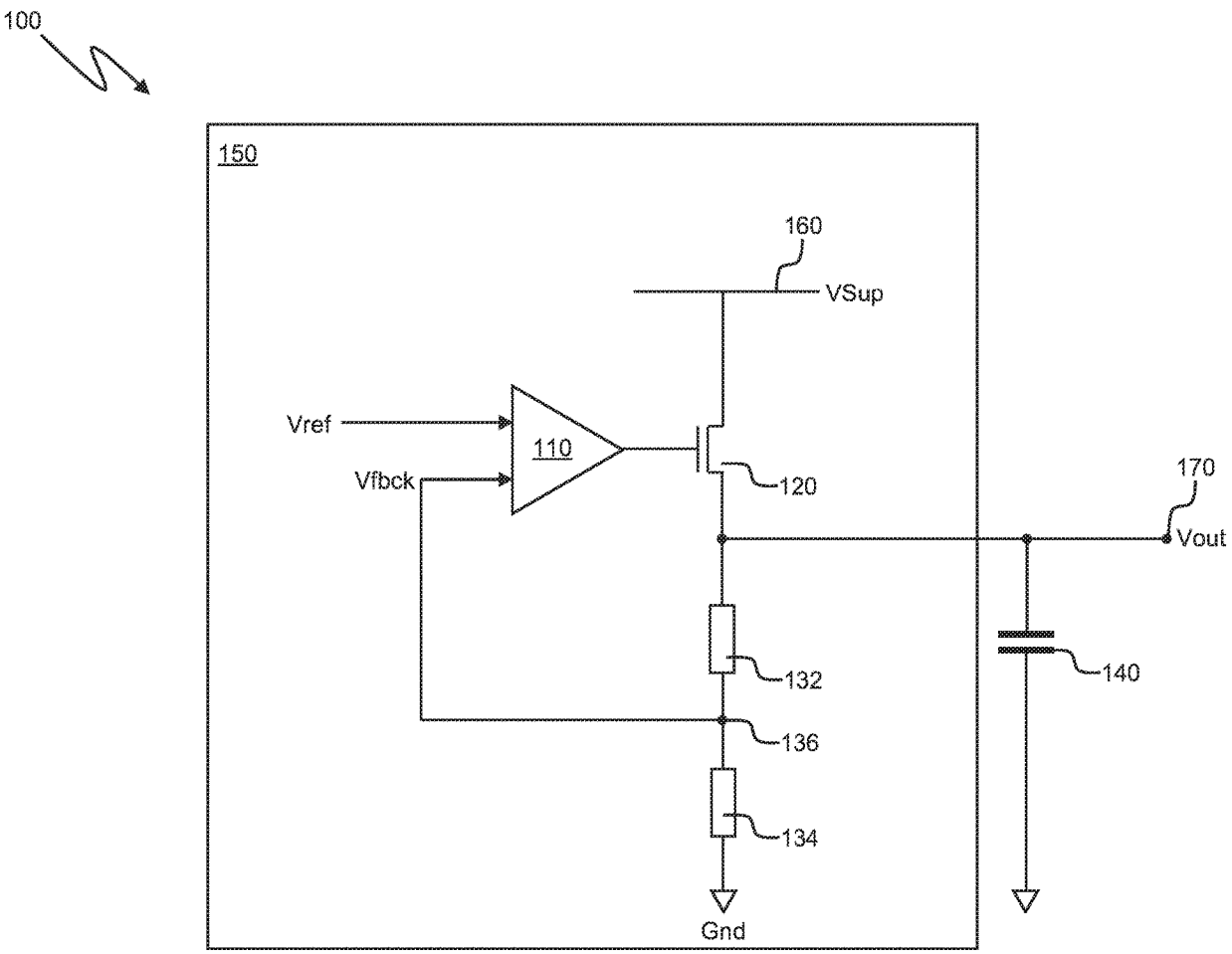
FIG. 1 is a schematic diagram illustrating typical low dropout (LDO) regulator circuitry.

In some applications it may be necessary to support LDO load current switching where the load current step is large, e.g. where a load such as a transducer that is coupled to the output terminal or node 170 of the LDO circuitry 100 of FIG. 1 to receive the regulated voltage supply Vout transitions from an inactive (e.g. switched off) state to an active (e.g. switched on) state, or vice versa. This may result in the LDO output device being moved from a relatively low, or possibly zero, output current bias state to a relatively high output current bias state (or vice versa) in a relatively short time, which in turn can result in unwanted output voltage droop (i.e. a reduction in the magnitude of the voltage Vout) and/or overshoot of the specified range of the regulated voltage supply Vout output by the LDO circuitry 100.

The reservoir capacitor 140 in the LDO circuitry 100 of FIG. 1 is coupled between the second terminal of the output device 120 and ground, and is provided to store energy to compensate for energy surges and thus transient effects on the regulated voltage supply Vout output by the LDO circuitry 100. In use of the LDO circuitry 100 the reservoir capacitor 140 stores charge, such that in the event of a sudden increase in load current (e.g. when a transducer that is coupled to the output terminal 170 is switched on or otherwise activated), at least a portion of the increased current demand can be supplied by the reservoir capacitor 140, thereby reducing the transient effect on the voltage output by the LDO circuitry 100.

In order to compensate effectively for such increased load current demand, the reservoir capacitor 140 may be relatively large in value and/or physical size.

To accommodate the power requirements of a relatively large reservoir capacitor 140, the output device 120 and the amplifier circuitry 110 may need to be relatively physically large, and/or may have relatively high power consumption. As will be appreciated by those skilled in the art, this increases the silicon area of the IC device 150. In arrangements in which the reservoir capacitor 140 is provided on-chip (i.e. as part of the IC device 150), additional area is required to implement the reservoir capacitor 140, which further increases the physical size of the IC device 150. whereas in arrangements in which the reservoir capacitor 140 is provided off-chip (i.e. externally of the IC device 150), an additional contact terminal (e.g. a pin, pad, ball or the like) is required in the IC device 150 to permit the external reservoir capacitor 140 to be coupled to the output device 120.

Thus it may be desirable to provide an LDO with reduced power consumption and/or reduced physical size. Such an LDO would, advantageously, be able to compensate for transient effects.

The present disclosure proposes to use a controllable shunt device such as a controlled switched resistance/current to support LDO load current changes, as will be described in more detail below with reference to FIGS. 2-6. The implementation of a programmable, sequenceable shunt resistance/current allows the LDO output device to be prebiased in anticipation of an external load current transition. This means that the LDO output device is not making a large transition from a zero/lower current state to a higher load current state (or vice versa).

The provision of a controllable shunt device permits a reduction in the value and/or physical size of the reservoir capacitor 140, such that in some cases an off-chip reservoir capacitor can be reduced in size or capacitance value, or replaced by an on-chip reservoir capacitor of a smaller capacitance value. In other cases the value and/or area of an on-chip reservoir capacitor can be reduced. Alternatively, an on-chip reservoir capacitance can be realised using parasitic capacitances present in the IC device 150, rather than by a dedicated reservoir capacitor. In a further alternative, an on-chip reservoir capacitance can be realised using a combination of parasitic capacitances and a smaller dedicated reservoir capacitor than would otherwise be required if no controllable shunt device were provided.

Such configurations may result in a reduction in the area of an IC implementation of the LDO, and a reduction in system power consumption, since the smaller reservoir capacitors employed in these configurations facilitate the use of a smaller output device 120 and amplifier circuitry 110, which consume less power than larger devices. Additionally such configurations may result in reduced cost, by obviating the need for external capacitors, or permitting the user of a smaller or wider tolerance (and therefore cheaper) off-chip capacitor.

Figure 2:
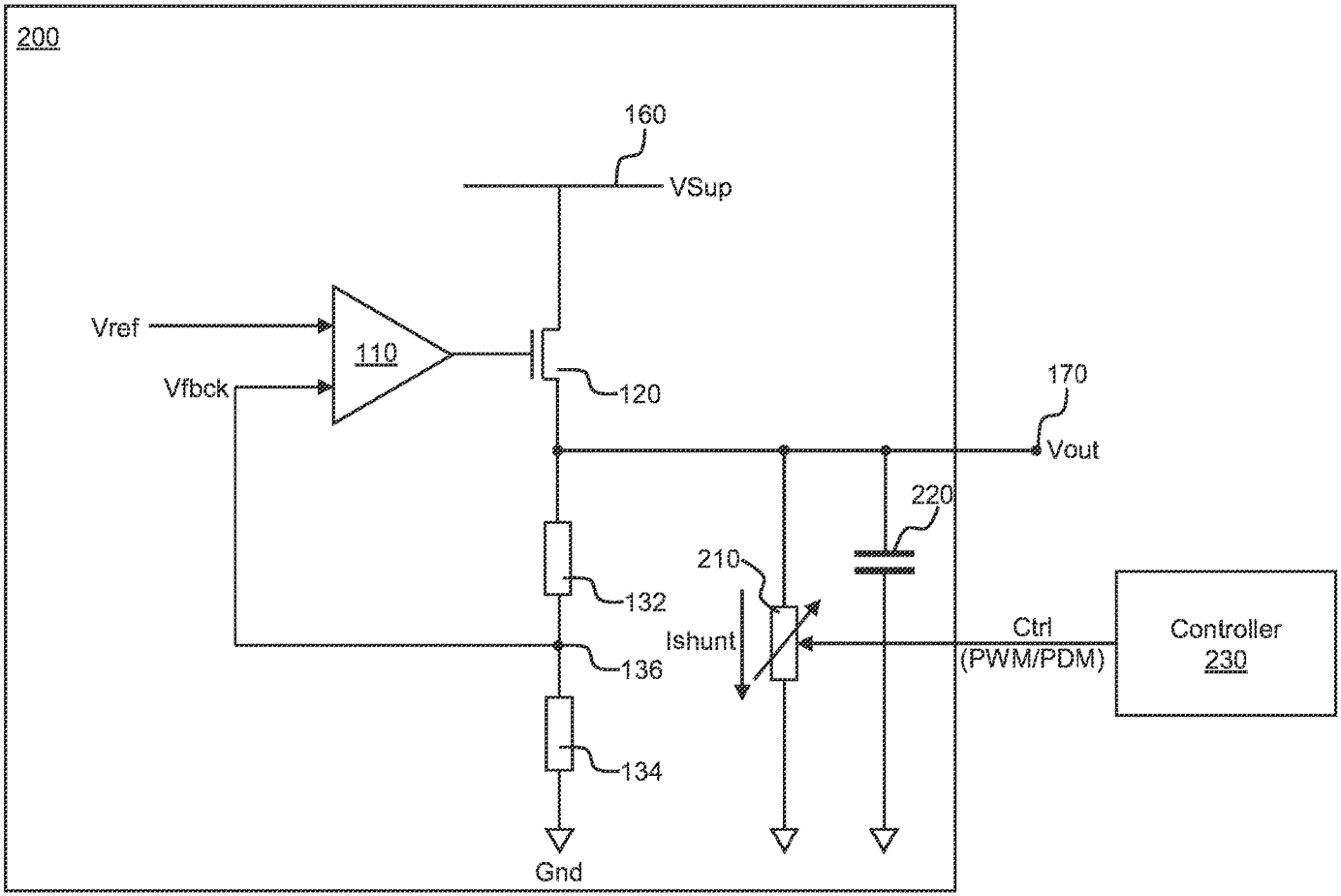
FIG. 2 is a schematic diagram illustrating LDO regulator circuitry according to the present disclosure.

FIG. 2 is a schematic diagram illustrating low dropout (LDO) regulator circuitry 200 according to the present disclosure. The circuitry 200 may be implemented, for example, as an integrated circuit device. The circuitry 200 includes a number of elements in common with the circuitry 100 of FIG. 1. Such common elements are denoted by common reference numerals and will not be described again in detail here.

The circuitry 200 differs from the circuitry 100 in that it includes one or more controllable shunt devices 210, coupled between the second terminal of the output device 120 and ground. Additionally, the reservoir capacitor 220 is smaller in area and/or capacitance value than the reservoir capacitor 140 of the circuitry 100 of FIG. 1. The reservoir capacitor 220 is shown in FIG. 2 as an on-chip device, but it will be appreciated from the discussion above that the reservoir capacitor 220 may alternatively be provided off-chip (i.e. external to an IC device that implements the circuitry 200). Thus, the reservoir capacitor 220 may be realised as a dedicated off-chip or on-chip device, or may be realised by an on-chip parasitic capacitance or by a combination of an on-chip parasitic capacitance and a dedicated reservoir capacitor device.

The controllable shunt device 210 provides a current path from the output device 120 for a variable shunt current. In this example the current path for the variable shunt current Ishunt is provided between the second terminal of the output device 120 and ground. By shunting a portion of the current that would otherwise flow through the voltage divider to ground through the controllable shunt device 210, the feedback voltage Vfbck is reduced. As the amplifier circuitry 110 and the associated feedback arrangement act to minimise any difference between Vref and Vfbck, a reduction in Vfbck causes the amplifier circuitry 110 to increase its output voltage to compensate for the reduction in the feedback voltage Vfbck, thereby increasing the bias voltage to the output device 120. The greater the shunt current Ishunt, the greater the increase in bias voltage of the output device 120.

The controllable shunt device 210 is configured to receive a control signal from a controller 230 of a host device (which may be, for example, a mobile telephone, a tablet or laptop computer, a gaming device, virtual reality or augmented reality headset device, "smart glasses" or other eyewear device or the like) incorporating the circuitry 200. The controller 230 may be a dedicated controller for controlling the controllable shunt device 210, or may be some other device such as an applications processor of the host device.

The controller 230 may control the controllable shunt device 210 so as to increase the shunt current Ishunt in advance of an expected increase in the load current, e.g. in advance of activation of a transducer or the like, thus increasing the bias voltage of the output device 120, thereby effectively "prebiasing" the output device 120 in anticipation of the load current increase. Thus, the magnitude of the voltage droop that occurs when the expected increase in load current occurs is less than would be the case in the circuitry 100 of FIG. 1.

Figure 3:
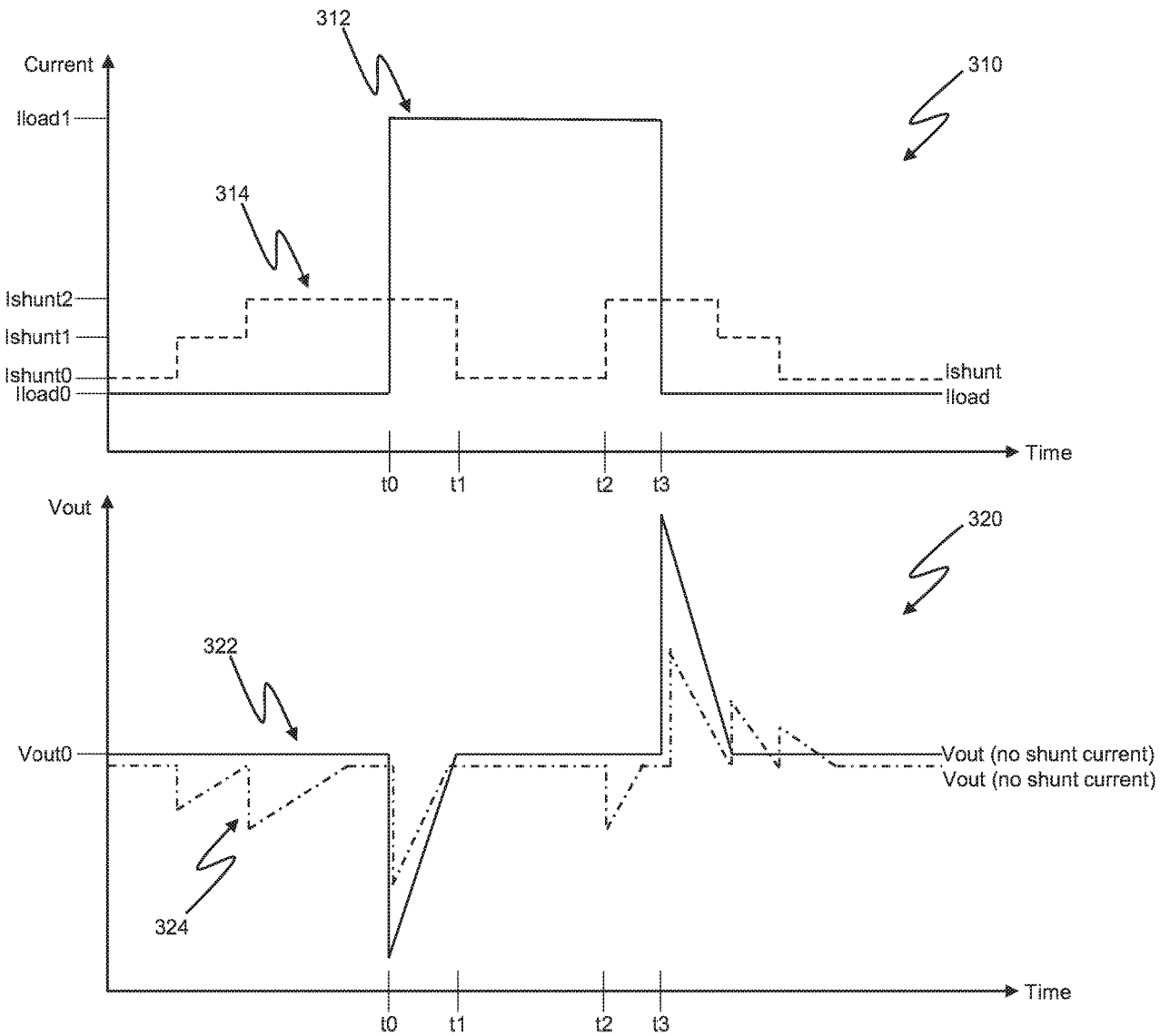
FIG. 3 shows illustrative current and voltage waveforms for the LDO regulator circuitry of FIG. 2.

The effect of the controllable shunt device 210 is illustrated in FIG. 3, which shows illustrative waveforms for the load current Iload and a shunt current Ishunt over time, and the corresponding regulated voltage supply Vout output by the LDO circuitry 200 when the shunt current Ishunt is not applied and when the shunt current is applied.

Thus, the waveform representation 310 in FIG. 3 shows the load current Iload over time (trace 312) and the shunt current Ishunt over time (trace 314). The waveform representation 320 shows the regulated output voltage supply Vout when the shunt current Ishunt is not applied (trace 322) and when the shunt current Ishunt is applied (trace 324).

As can be seen in trace 312, a step increase in the load current Iload from a first current level Iload0 to a second current level Iload1 occurs at a time t0, and a step decrease in the load current Iload from Iload1 to Iload0 occurs at a time t3.

The regulated supply voltage Vout output by the LDO circuitry 200 is initially maintained at a level Vout0, which is within the regulated supply voltage range specified for the LDO circuitry 200.

In the absence of any shunt current Ishunt, a severe drop in the magnitude of the regulated voltage supply Vout occurs at the time t0 (or very soon thereafter), as indicated in trace 322, as a result of the step increase in the load current Iload. The magnitude of the regulated voltage supply Vout subsequently stabilises over time, recovering over time to its normal level Vout0 as the amplifier circuitry 110 and associated feedback loop act to minimise the difference between Vref and Vfbck, as described above. At the time t3 (or very soon thereafter), a large increase in the magnitude of the regulated voltage supply Vout output by the LDO circuitry 200 (trace 320) occurs, as a result of the step decrease in the load current Iload. The magnitude of the regulated voltage supply Vout subsequently stabilises, recovering over time to its normal level Vout0, as the amplifier circuitry 110 and associated feedback loop again act to minimise the difference between Vref and Vfbck.

The trace 314 in FIG. 3 is indicative of a varying shunt current Ishunt that may be applied by appropriate control of the controllable shunt device 210. In the example shown in FIG. 3 the shunt current Ishunt increases in two steps from a first level Ishunt0 to a second, higher, level Ishunt2, during a time period prior to t0. Thus, at the time t0 (at which the step increase in the load current Iload occurs), the shunt current Ishunt has increased from Ishunt0 to Ishunt2 (via an intermediate level Ishunt1). As shown in trace 324 of FIG. 3, at each step increase in the shunt current Ishunt, the magnitude of Vout decreases, subsequently recovering over time to its normal level Vout0, as the amplifier circuitry 110 and associated feedback loop act to minimise the difference between Vref and Vfbck.

As can be seen from the trace 324 in FIG. 3, at (or soon after) t0, at which the step increase in Iload occurs, the magnitude of Vout decreases. However, the deviation in Vout (i.e. the decrease in the magnitude of Vout) is less severe than in the case where no shunt current is applied. The application of the increased shunt current Ishunt2 prior to t0 prebiases the output device 120 of the LDO circuitry 200, thereby reducing the difference between the prevailing bias voltage to the output device 120 at the time (t0) at which the step increase in the load current Iload occurs and the increased bias voltage that is subsequently required to maintain Vout at its rated level for the increased load current Iload, thus allowing Vout to recover more quickly to its normal level Vout0 and thereby reducing the severity of the decrease in the magnitude of Vout as a result of the increased load current Iload, in comparison with the situation shown in trace 322 in which no shunt current Ishunt flows.

Once Vout has stabilised, e.g. recovered to its normal level Vout0 (at a time t1), the controller 230 may control the controllable shunt device 210 to reduce the shunt current Ishunt to its first level Ishunt0. In this example the reduction in the shunt current Ishunt is performed in a single step. However, it will be understood that this reduction in the shunt current Ishunt may be performed in two or more steps if desired. Reducing the shunt current Ishunt in this way helps to reduce the power consumption of the circuitry 200 when an increased shunt current is no longer required to pre-bias the output device 120.

In anticipation of the step decrease in the load current Iload that occurs at t3, the controller 230 may control the controllable shunt device 210 so as to again increase the shunt current Ishunt to its second level Ishunt2. In this instance the increase in the shunt current Ishunt can be performed in a single step and does not give rise to any significant reduction in Vout, as the magnitude of Ishunt, even at its second level Ishunt2, is significantly less than Iload and thus does not increase the total current draw enough to cause any significant reduction in Vout. However, it will be understood that this increase in the shunt current Ishunt may be performed in two or more steps if desired.

At (or shortly after) t3, at which the step decrease in Iload occurs, the magnitude of Vout increases. However, as shown in trace 324, the deviation in Vout (i.e. the increase in the magnitude of Vout) is less severe than in the case where no shunt current is applied. The application of the increased shunt current Ishunt2 prior to t3 ensures that, after the step decrease in Iload at t3, current is still being drawn through the output device 120, thus reducing the severity of the increase in Vout that occurs as a result of the step decrease in Iload that occurs at t3, in comparison with the situation shown in trace 322 in which no shunt current Ishunt is applied.

Once Vout has recovered to its normal level Vout0, or close to its normal level, the controller 230 may control the controllable shunt device 210 to reduce the shunt current Ishunt to its first level Ishunt0, in this example in two steps. Each step decrease in Ishunt gives rise to a small temporary increase in Vout before Vout recovers to its normal level Vout0. Again, reducing Ishunt to its first level Ishunt0 in this way helps to reduce the power consumption of the circuitry 200 when an increased shunt current is no longer required to pre-bias the output device 120.

As will be apparent from the discussion above and the waveforms of FIG. 3, through adjustment of the control signal Ctrl to the programmable shunt device 210, the shunt current Ishunt can be increased, so that the output device 120 of the LDO circuitry 200 can be kept at or close to saturation, so that the increase in Iload does not result in a large transient effect on the magnitude or level of Vout.

As will further be apparent from the discussion above and the waveforms of FIG. 3, the shunt current Ishunt can be programmable, with the current profile controlled in anticipation of the load current Iload condition.

The controller 230 may be arranged to receive inputs from other connected systems or from a central controller such as a CPU or applications processor (AP) of a host device that incorporates the LDO circuitry 200, such that the controller 230 may predict the load current conditions which may be experienced by the output device 120, and may adjust the shunt current Ishunt accordingly, by issuing appropriate control signals to the controllable shunt device 210.

For example, at the time of initialization or power-up of a host device incorporating the LDO circuitry 200, it may be known that particular subsystems of the host device require power to perform initialization operations such as reading information from memory such as one-time programmable (OTP) memory or performing Built-In Self-Test (BIST) operations to ensure the host device is functioning correctly. In such a situation, the load level for the host device can be relatively accurately predicted, and the programmable LDO shunt current can be increased or decreased (e.g. ramped or stepped up or down) according to the anticipated level, to reduce the risk of large transients appearing in the output voltage Vout of the LDO circuitry 200.

Similarly, when the host device is put into an inactive or standby mode, it can be predicted that the load requirements for the host device will be minimized. In such a case, the programmable shunt current Ishunt can be reduced (e.g. ramped or stepped down) or deactivated entirely, to conserve power, by means of appropriate control signals issued to the controllable shunt device 210 by the controller 230.

During further operation of such a host device, system operations or user commands may require the initialization or deactivation of different subsystems of the host device, which may allow for estimation of future load demands for the host device. Such changes in the operation of the device may be used to increase or decrease (e.g. ramp or step up or down) the programmable shunt current Ishunt accordingly, again by means of appropriate control signals issued to the controllable shunt device 210 by the controller 230.

Thus the LDO circuitry 200 may be operable in a plurality of different modes, each associated with a different level of shunt current Ishunt, and may be switchable between the different modes of operation in response to a control signal received by the controllable shunt device 210.

In the example described above with reference to FIG. 3, the LDO circuitry has two modes of operation.

In a first mode, which may be referred to as a "standby mode", the controllable shunt device 210 may adopt a first configuration or value in which the shunt current Ishunt is at a first level Ishunt0. The first level Ishunt0 may be 0 or some non-zero positive value. The standby mode may be a default operating mode of the LDO circuitry 200.

In a second mode, which may be referred to as an "active mode", the controllable shunt device 210 may adopt a second configuration or value in which the shunt current Ishunt is at a second level Ishunt2, which is higher than the first level Ishunt0. The LDO circuitry 200 may be switched into its active mode by the controller 230 (by issuing appropriate control signals to the controllable shunt device 210) in response to detection of a forthcoming increase in load current, such as may occur, for example, when a transducer of a host device incorporating the LDO circuitry 200 is powered on.

In switching between the standby mode and the active mode, the shunt current may increase from the first level Ishunt0 to the second level Ishunt2 in a single step, or may increase from the first level Ishunt0 to the second level Ishunt2 in two or more steps. In the example illustrated in FIG. 3, the shunt current Ishunt first increases to an intermediate level Ishunt1 (which is greater than Ishunt0 but less than Ishunt2) and subsequently increases to the higher level Ishunt2.

It will be appreciated that the LDO circuitry 200 may have more than two modes. For example, the LDO circuitry 200 may have a plurality (e.g. eight) of modes of operation, each associated with a different level of shunt current Ishunt. The level of the shunt current is controlled by the controllable shunt device 210, and the LDO circuitry 200 may be switchable between modes in response to an appropriate control signal or control signals received by the controllable shunt device 210, e.g. from the controller 230.

In addition or alternatively, it will be understood from the discussion above and the waveforms of FIG. 3 that the programmable shunt current Ishunt can be reduced in a controlled, stepped fashion (again by means of appropriate control signals issued to the controllable shunt device 210 by the controller 230), when Vout is stable in high load current Iload mode. This reduces the host device power consumption when a stable operation has been reached.

The characteristics of changes (increases/decreases) in the shunt current Ishunt may be adjustable, by means of appropriate control signals issued by the controller 230 to the controllable shunt device. For example, the step size of the shunt current Ishunt may be adjustable. Additionally or alternatively, a rate of change of the shunt current Ishunt may be adjustable. For example, the shunt current Ishunt may change (increase or decrease) in a ramped manner, rather than in a stepped manner, and the gradient of the ramp (i.e. the rate of change of the shunt current Ishunt over time) may be variable according to a control signal issued by the controller 230. Additionally or alternatively, a lower endpoint value of the shunt current (e.g. Ishunt0 in FIG. 3) and an upper endpoint value of the shunt current (e.g. Ishunt2 in FIG. 3) may be adjustable. Further, the lower endpoint value (e.g. Ishunt0) of the shunt current Ishunt may be 0 or some positive non-zero value.

In operation of the LDO circuitry 200, a static shunt load may be presented to a circuit, but it will be understood that the level of the static shunt load may be adjustable to account for anticipated host device conditions, as described above.

In some examples, the controller 230 may be operative to output a control signal to switch the controllable shunt device 210 off, such that no shunt current flows during normal operation of the LDO circuitry (e.g. when load current drawn by the load is substantially constant), and to output a control signal to switch the controllable shunt device 210 on so as to provide a required or desired shunt current in anticipation of a change in the load current.

The controllable shunt device 210 may be implemented in a number of different ways, as will now be described with reference to FIGS. 4, 5 and 6.

Figure 4:
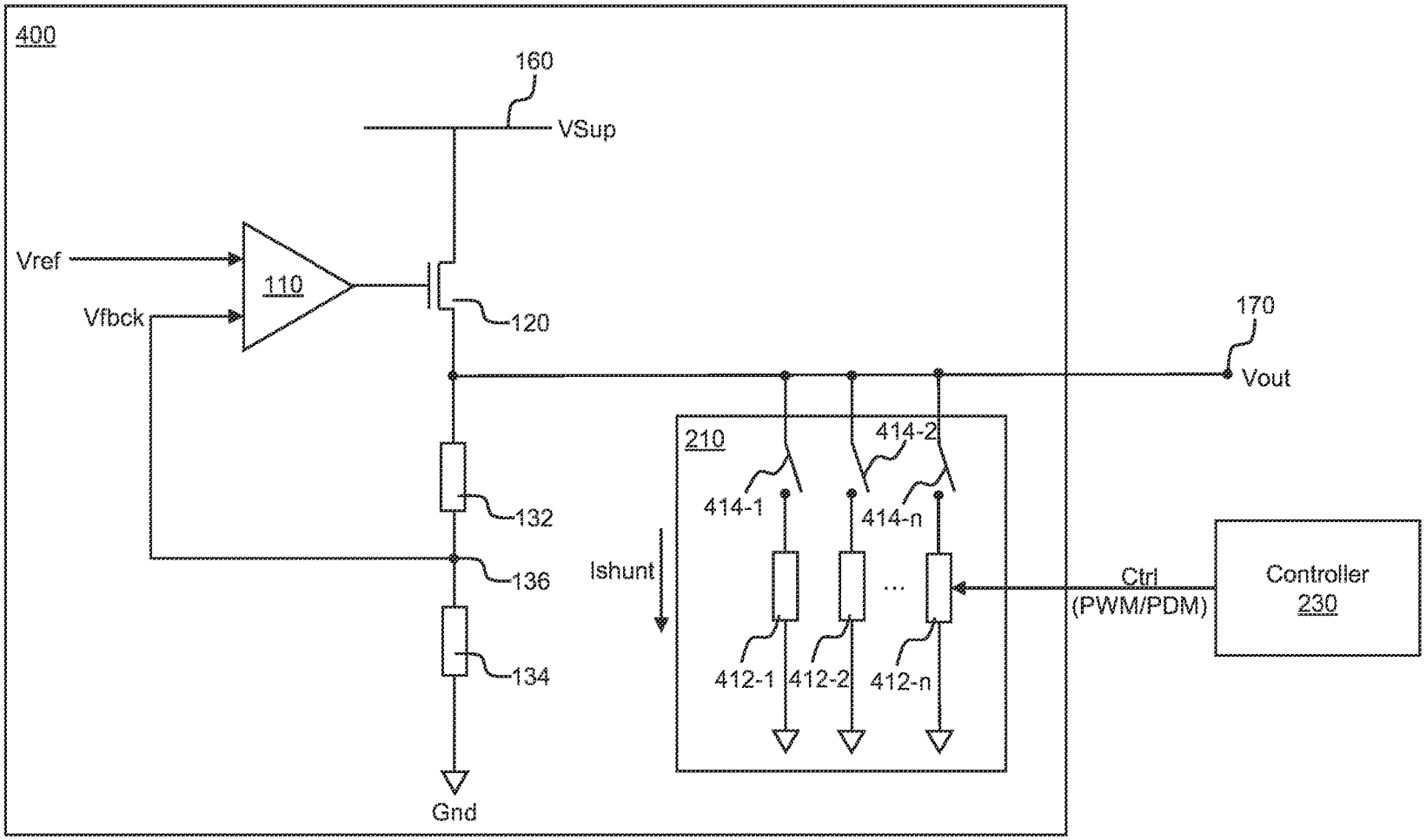
FIG. 4 is a schematic diagram illustrating an example of LDO regulator circuitry according to the present disclosure.

FIG. 4 is a schematic diagram showing example LDO circuitry 400 according to the present disclosure. Again, the circuitry 400 may be implemented, for example, as integrated circuitry, e.g. as an IC device. The circuitry 400 includes a number of elements in common with the circuitry 200 of FIG. 2. Such common elements are denoted by common reference numerals and will not be described again in detail here. Note that for clarity the reservoir capacitor 220 has been omitted from FIG. 4, but it is to be understood that a reservoir capacitor 220 may be provided as part of the circuitry 400, either as an off-chip device or an on-chip device that can be realised using either a dedicated reservoir capacitor, or using on-chip parasitic capacitance, or using a combination of both a dedicated reservoir capacitor and on-chip parasitic capacitance.

In the example LDO circuitry 400, the controllable shunt device 210 is implemented as a plurality of resistances **412-1-412-*n*, each of which can be selectively coupled between the second terminal of the output device 120 and ground, by means of a respective switch 414-1-414-*n*. Thus, by selectively opening and closing the switches 414-1-414-*n* in accordance with one or more control signals Ctrl issued by the controller 230, the controllable shunt device 210** can be programmed with a desired shunt resistance value, thus allowing a desired shunt current Ishunt to be achieved.

The resistances **412-1-412-*n* may be of equal resistance value, or the resistance values of the resistances 412-1-412-*n* may differ from one another. For example, the resistance values of the resistances 412-1-412-*n*** may follow a binary weighting scheme, or may be weighted in any other convenient manner.

The switches **414-1-414-*n* can be controlled by a control signal Ctrl issued by the controller 230. The control signal Ctrl may be, for example, an n-bit digital word, where n is equal to the number of resistances 412-1-412-*n* and switches 414-1-414-*n*. Thus, each bit of the control signal Ctrl may directly control the operation of one of the switches 414-1-414-*n***.

In the example illustrated in FIG. 4 the resistances **412-1-412-*n* are arranged in parallel with each other, but it will be appreciated that any other suitable arrangement of the resistances 412-1-412-4** (e.g. a ladder arrangement or the like) that provides a resistance value that is variable according to the control signal Ctrl may equally be implemented.

Figure 5:
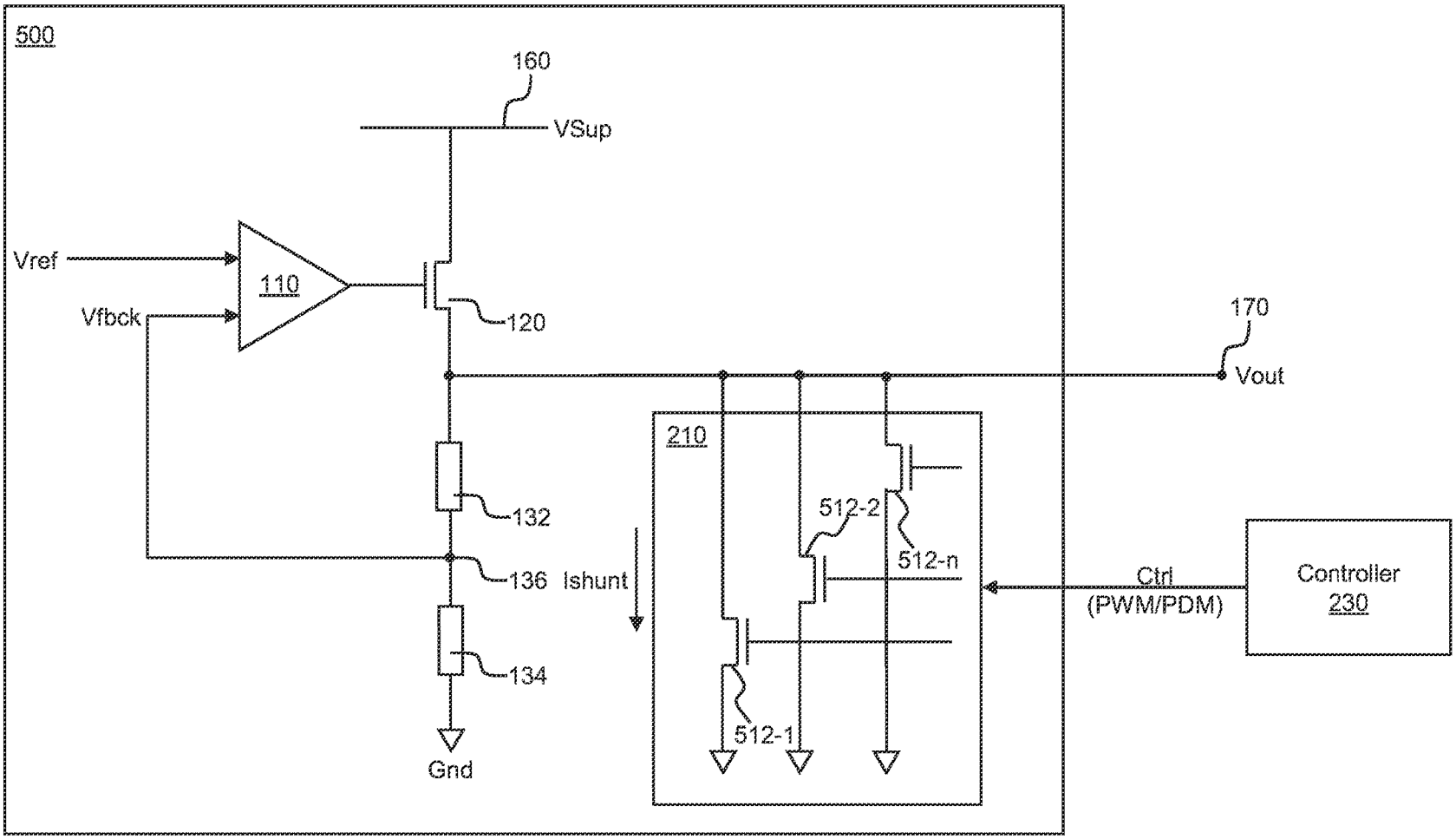
FIG. 5 is a schematic diagram illustrating a further example of LDO regulator circuitry according to the present disclosure.

FIG. 5 is a schematic diagram showing further example LDO circuitry 500 according to the present disclosure. The circuitry 500 may be implemented, for example, as integrated circuitry, e.g. as an IC device. Again, the circuitry 500 includes a number of elements in common with the circuitry 200 of FIG. 2. Such common elements are denoted by common reference numerals and will not be described again in detail here. Note that for clarity the reservoir capacitor 220 has been omitted from FIG. 5, but it is to be understood that a reservoir capacitor 220 may be provided as part of the circuitry 500, either as an off-chip device or an on-chip device that can be realised using either a dedicated reservoir capacitor, or using on-chip parasitic capacitance, or using a combination of both a dedicated reservoir capacitor and on-chip parasitic capacitance.

In the circuitry 500, the controllable shunt device 210 is implemented as a plurality of transistors (e.g. MOSFETs) **512-1-512-*n*, each having a fixed on-resistance. The on-resistances of the plurality of transistors 512-1-512-*n* may all be equal, or may differ from each other. For example, the on-resistance values of the transistors 512-1-512-*n*** may follow a binary weighting scheme, or may be weighted in any other convenient manner.

The transistors **512-1-512-*n* can be controlled by a control signal Ctrl issued by the controller 230. The control signal Ctrl may be, for example, an n-bit digital word, where n is equal to the number of transistors 512-1-512-*n*. Thus, each bit of the control signal Ctrl may directly control the operation of one of the transistors 512-1-512-*n***, such that the control word can be used to select a desired shunt resistance value.

Alternatively, the plurality of transistors **512-1-512-*n* may each have a controllable on-resistance, which varies according to, e.g. a voltage applied to its control terminal. Thus, by applying appropriate control signals (e.g. voltages) to the control terminals of the transistors, the controllable shunt device 210** can be programmed with a desired shunt resistance value, thus allowing a desired shunt current Ishunt to be achieved.

Although FIG. 5 shows the use of a plurality of transistors **512-1-512-*n* coupled in parallel, it will be appreciated that in some examples only a single transistor (e.g. 512-1) may be required to implement the controllable shunt device 210**.

Figure 6:
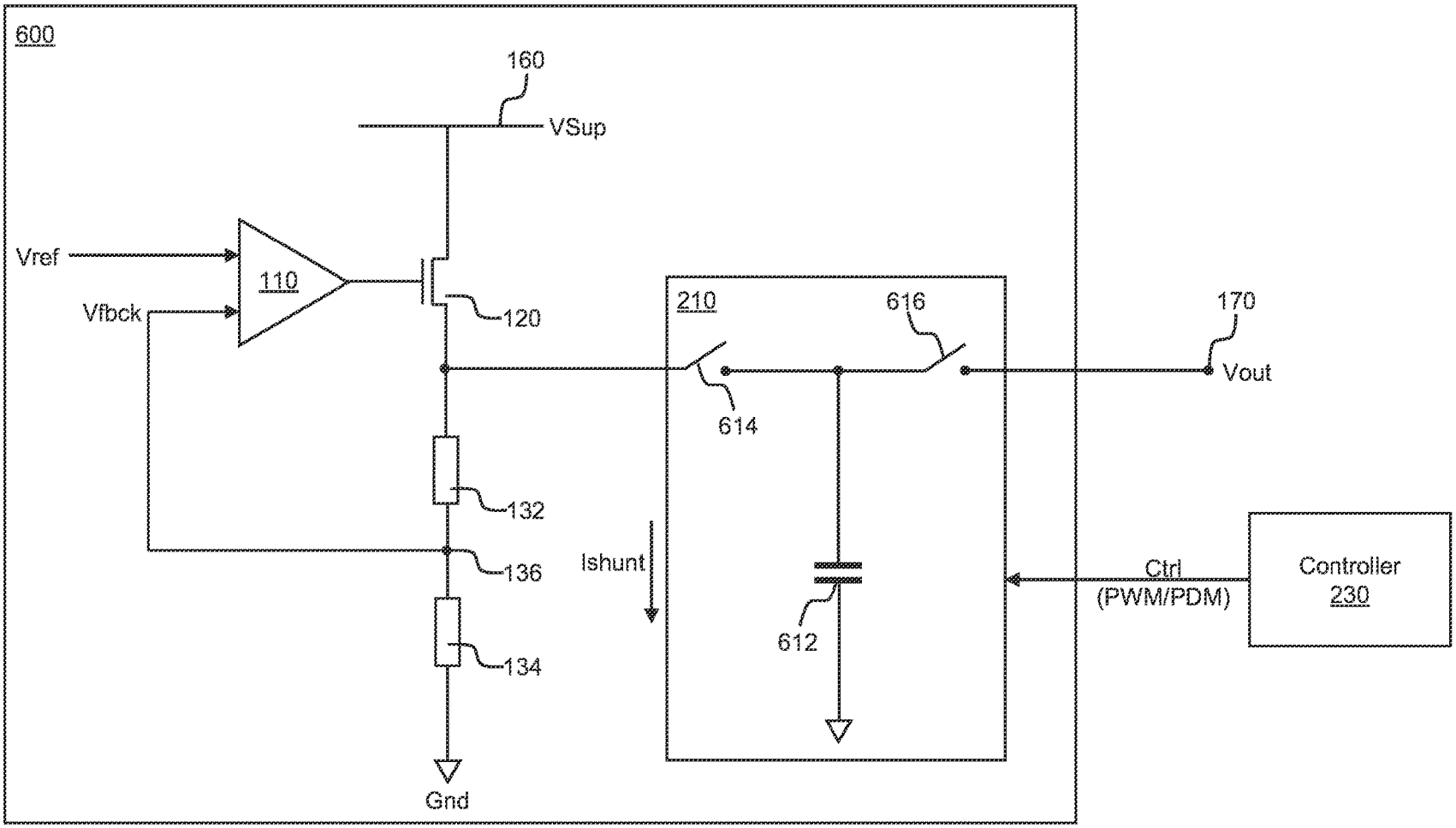
FIG. 6 is a schematic diagram illustrating a further example of LDO regulator circuitry according to the present disclosure.

FIG. 6 is a schematic diagram showing example LDO circuitry 600 according to the present disclosure. Again, the circuitry 600 may be implemented, for example, as integrated circuitry, e.g. as an IC device. The circuitry 600 includes a number of elements in common with the circuitry 200 of FIG. 2. Such common elements are denoted by common reference numerals and will not be described again in detail here. Note that for clarity the reservoir capacitor 220 has been omitted from FIG. 6, but it is to be understood that a reservoir capacitor 220 may be provided as part of the circuitry 600, either as an off-chip device or an on-chip device that can be realised using either a dedicated reservoir capacitor, or using on-chip parasitic capacitance, or using a combination of both a dedicated reservoir capacitor and on-chip parasitic capacitance.

In the example LDO circuitry 600, the controllable shunt device 210 is implemented using switched capacitor resistor circuitry comprising a capacitor 612 that can be coupled between the second terminal of the output device 120 and ground, by means of a first switch 614, and between the output terminal 170 and ground, by means of a second switch 616. The first and second switches 614, 616 are closed and opened on an alternating basis, in accordance with a switching frequency fs, to alternately charge and discharge the capacitor 612. The effective resistance R of the switched capacitor resistor circuitry is defined as $$R = \frac{1}{Cfs},$$

where C is the capacitance value of the capacitor 612. The switching frequency fs can be controlled by a control signal Ctrl issued by the controller 230 so as to control the resistance R and hence the shunt current Ishunt.

As will be appreciated by those of ordinary skill in the art, the switched capacitor resistor circuitry may include further capacitors coupled in parallel with the capacitor 612, each capacitor (i.e. the capacitor 612 and each of the further capacitors) being associated with a series-connected selector switch that can be controlled (e.g. by the controller 230) to selectively couple that capacitor to the first and second switches 614, 616. The further capacitors may be of the same capacitance value as the capacitor 612, or may be of different capacitance values. By controlling the series-connected selector switches, one or more of the capacitors may be coupled to the first and second switches 614, 616. This allows the capacitance value C to be adjusted. Permitting control of both the switching frequency fs and the capacitance value C in this way facilitates fine control of the resistance value R and hence the shunt current Ishunt.

As will be apparent to those of ordinary skill in the art, FIGS. 4, 5 and 6 represent just some possible implementations of the controllable shunt device 210, and the controllable shunt device 210 may equally be implemented in other ways to achieve the controllable shunt current Ishunt.

In the examples described above with reference to FIGS. 4, 5 and 6, the selectable elements (resistances, transistor on-resistances or capacitances) of the controllable shunt device 210 are selected in accordance with simple on/off control signals Ctrl issued by the controller 230, e.g. in response to an expected change in the load current Iload, so as to generate a desired shunt current Ishunt.

In other examples, however, the shunt current Ishunt could be generated using switching schemes such as pulse width modulation (PWM) or pulse density modulation (PDM). Thus, the control signals Ctrl supplied by the controller 230 to set the shunt current Ishunt (e.g. in response to an expected change in the load current Iload) could be PWM or PDM signals, such that the selectable elements **412-1-412-*n*, 512-1-512-*n*, 612-1-612-*n* are selected and deselected (i.e. coupled to and decoupled from the output device 120**) in accordance with a duty cycle of the control signal Ctrl. In this way a desired average shunt current over a period (or a plurality of periods) of the PWM or PDM control signal Ctrl can be achieved.

An aspect of the present disclosure also extends to shunt circuitry comprising a controllable shunt device of the kind described above, configured to be coupled to LDO circuitry so as to provide a controllable shunt current, based on a control signal received by the controllable shunt device, to reduce a level of deviation of the regulated voltage supply Vout output by the LDO circuitry from its rated voltage in the event of a sudden change in a load current drawn by a load that is supplied with the regulated voltage supply Vout. In this aspect the shunt circuitry can be coupled to existing LDO circuitry in place of or in addition to a reservoir capacitor in order to reduce the deviation in the As will be apparent from the foregoing description, the present disclosure facilitates a reduction in the value and/or physical size of the reservoir capacitor of an LDO. In some cases an off-chip reservoir capacitor can be reduced in size or capacitance value, or replaced by an on-chip reservoir capacitor of a smaller capacitance value. In other cases the capacitance value and/or area of an on-chip reservoir capacitor can be reduced. In some examples the reduction in size and/or capacitance value of the reservoir capacitance that is facilitated by the provision of a controllable shunt current is such that an on-chip reservoir capacitance can be realised using parasitic capacitances present in the IC device, rather than by a dedicated reservoir capacitor, or that an on-chip reservoir capacitance can be realised using a combination of parasitic capacitances and a smaller dedicated reservoir capacitor than would otherwise be required if no controllable shunt device were provided.

Such configurations may result in a reduction in the area of an IC implementation of the LDO, a reduction in system power consumption and reduced cost of the LDO.

In implementations in which a dedicated reservoir capacitance is not required, the area, pin count and power consumption of an IC implementation of the LDO circuitry may be reduced.

Thus, the present disclosure provides an LDO regulator comprising an output device arranged to provide an output voltage, and a shunt device to provide a shunt resistance/current to the output device to pre-bias the output device, wherein the shunt device is arranged to adjust the level of the shunt resistance/current based on a received control signal.

The use of an adjustable shunt device allows for the shunt resistance/current to be varied, in anticipation of an external load current transition.

The LDO regulator may receive an indication of a use-case or status of a device with or comprising the LDO regulator, wherein the shunt device adjusts the level of the shunt resistance/current based on the indication of use-case or status.

The shunt device may comprise one or more switchable devices, e.g. MOSFETs, which are individually controlled to adjust the shunt resistance/current provided by the shunt device. In such a case, the received control signal may comprise a control word, wherein individual bits of the control word are used to control the on/off switching of the one or more switchable devices.

The shunt device may be arranged to reduce the shunt resistance/current when the LDO is in a stable mode, e.g. when the output voltage is stable in a high load current mode.

It will be understood that the shunt device may be arranged to reduce the shunt resistance/current to zero.

In a further aspect, the shunt device may be arranged to control characteristics of the adjustment of the shunt resistance/current, e.g. adjustable step size of shunt resistance/current, adjustable rate of change of shunt resistance/current, and/or adjustable upper or lower endpoints of shunt resistance/current.

There is further provided a circuit comprising an LDO regulator as described above.

There is further provided a host device comprising an LDO regulator as described above.

There is also provided shunt circuitry for an LDO regulator, the shunt circuitry comprising an adjustable shunt resistance/current arranged to be coupled to an output device of an LDO regulator, wherein the shunt device is arranged to adjust the level of the shunt resistance/current based on a received control signal.

Embodiments may be implemented as an integrated circuit which in some examples could be a codec or audio DSP or similar. Embodiments may be incorporated in an electronic device, which may for example be a portable device and/or a device operable with battery power. The device could be a communication device such as a mobile telephone or smartphone or similar. The device could be a computing device such as a notebook, laptop or tablet computing device. The device could be a wearable device such as a smartwatch. The device could be a device with voice control or activation functionality such as a smart speaker. In some instances the device could be an accessory device such as a headset, headphones, earphones, earbuds or the like to be used with some other product.

The skilled person will recognise that some aspects of the above-described apparatus and methods, for example the discovery and configuration methods may be embodied as processor control code, for example on a non-volatile carrier medium such as a disk, CD- or DVD-ROM, programmed memory such as read only memory (Firmware), or on a data carrier such as an optical or electrical signal carrier. For many applications, embodiments will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re) programmable analogue array or similar device in order to configure analogue hardware.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

The invention claimed is:

1. Low-dropout regulator circuitry comprising:

an output device configured to provide a regulated output voltage;

differential amplifier circuitry configured to provide a bias voltage to the output device;

a feedback path between an output of the output device and an input of the differential amplifier circuitry for providing a feedback voltage to the input of the differential amplifier circuitry; and a controllable shunt device configured to provide a current path from the output device for a shunt current to adjust the feedback voltage, wherein the shunt current is variable according to a control signal supplied to the controllable shunt device, wherein the control signal comprises a pulse width modulated (PWM) or pulse density modulated (PDM) signal such that the controllable shunt device is controlled in accordance with a duty cycle of the control signal, wherein the control signal is supplied by a controller, and wherein the controller is configured to supply the control signal to cause the controllable shunt device to increase the shunt current prior to an expected decrease in a load current drawn by a load coupled to the low-dropout regulator circuitry, to reduce a magnitude of a change in an output voltage of the low-dropout regulator circuitry that occurs as a result of the decrease in the load current.

2. The low-dropout regulator circuitry according to claim 1, wherein the controller is configured to supply the control signal to cause the controllable shunt device to increase the shunt current when an increase in a load current drawn by a load coupled to the voltage regulator circuitry is expected.

3. The low-dropout regulator circuitry according to claim 2, wherein the controllable shunt device is operative to increase the shunt current in a plurality of steps.

4. The low-dropout regulator circuitry according to claim 1, wherein the controllable shunt device is operative to increase the shunt current in a single step or in a plurality of steps.

5. The low-dropout regulator circuitry according to claim 1, wherein a step size for increasing or decreasing the shunt current is variable, or wherein a rate of change of increase or decrease of the shunt current is variable.

6. The low-dropout regulator circuitry according to claim 1, wherein lower and upper endpoint values for the shunt current are variable.

7. The low-dropout regulator circuitry according to claim 1, wherein a lower endpoint value for the shunt current is zero.

8. The low-dropout regulator circuitry according to claim 1, wherein the voltage regulator circuitry further comprises controller circuitry configured to provide the control signal to the controllable shunt device.

9. The low-dropout regulator circuitry according to claim 8 wherein the controller circuitry is configured to receive one or more inputs from circuitry of a host device and to output the control signal to cause the controllable shunt device to adjust the shunt current based on the received input(s).

10. The low-dropout regulator circuitry according to claim 1, wherein the controller circuitry is operative to output the control signal to switch the controllable shunt device off such that no shunt current flows during normal operation of the voltage regulator circuitry, and to output the control signal to switch the controllable shunt device on so as to provide a shunt current in anticipation of a change in the load current.

11. The low-dropout regulator circuitry according to claim 1 wherein the controllable shunt device comprises one or more controllable resistances or switched capacitor circuitry implementing one or more controllable resistances.

12. Circuitry comprising the low-dropout regulator circuitry of claim 1 and a reservoir capacitor.

13. An integrated circuit comprising the circuitry of claim 1.

14. A device comprising the circuitry of claim 1, wherein the device comprises a portable device, a battery powered device, a mobile telephone, a tablet or laptop computer, a smart speaker, an accessory device, a headset device, smart glasses, headphones, earphones or earbuds.

15. The low-dropout regulator circuitry according to claim 1, wherein the controller is configured to supply the control signal to cause the controllable shunt device to reduce the shunt current when the regulated output voltage has stabilised following a change in a load current drawn by a load coupled to the voltage regulator circuitry.

16. The low-dropout regulator circuitry according to claim 15, wherein the controllable shunt device is operative to decrease the shunt current in a single step or in a plurality of steps.

17. Voltage regulator circuitry comprising a controllable shunt device configured to control a shunt current, wherein the voltage regulator circuitry is operable in a plurality of modes, each of the plurality of modes associated with a different shunt current level, wherein the voltage regulator circuitry is switchable between modes in response to a control signal received by the controllable shunt device, wherein the control signal comprises a pulse width modulated (PWM) or pulse density modulated (PDM) signal such that the controllable shunt device is controlled in accordance with a duty cycle of the control signal, wherein the control signal is supplied by a controller, and wherein the controller is configured to supply the control signal to cause the controllable shunt device to increase the shunt current prior to an expected decrease in a load current drawn by a load coupled to the voltage regulator circuitry, to reduce a magnitude of a change in an output voltage of the low-dropout regulator circuitry that occurs as a result of the decrease in the load current.

* * * * *